US008499841B2

(12) United States Patent
Tinker

(10) Patent No.: US 8,499,841 B2
(45) Date of Patent: Aug. 6, 2013

(54) FRAC SLEEVE WITH ROTATIONAL INNER DIAMETER OPENING

(75) Inventor: Donald W. Tinker, Rapid City, MI (US)

(73) Assignee: Team Oil Tool, LP, The Woodlands, TX (US)

( * ) Notice: Subject to any disclaimer, the term of this patent is extended or adjusted under 35 U.S.C. 154(b) by 297 days.

(21) Appl. No.: 12/613,383

(22) Filed: Nov. 5, 2009

(65) Prior Publication Data

US 2010/0132959 A1 Jun. 3, 2010

Related U.S. Application Data

(60) Provisional application No. 61/111,448, filed on Nov. 5, 2008.

(51) Int. Cl.
*E21B 33/124* (2006.01)

(52) U.S. Cl.
USPC ..... 166/386; 166/318; 166/377

(58) Field of Classification Search
USPC ..... 166/318, 377, 386
See application file for complete search history.

(56) References Cited

U.S. PATENT DOCUMENTS

| | | | | |
|---|---|---|---|---|
| 4,049,015 | A * | 9/1977 | Brown | 137/496 |
| 5,161,617 | A * | 11/1992 | Marschke | 166/298 |
| 5,197,547 | A * | 3/1993 | Morgan | 166/387 |
| 5,411,095 | A * | 5/1995 | Ehlinger et al. | 166/317 |
| 6,907,936 | B2 * | 6/2005 | Fehr et al. | 166/387 |
| 7,108,067 | B2 * | 9/2006 | Themig et al. | 166/317 |

* cited by examiner

*Primary Examiner* — David Bagnell
*Assistant Examiner* — Richard Alker
(74) *Attorney, Agent, or Firm* — Jeffrey A. Pyle; Lee, Jorgensen, Pyle & Kewalramani, PC

(57) ABSTRACT

The present application is to a method of sequentially drilling a number of frac sleeves in a down hole well. The design enables the removal of fracture sleeve pistons from between treatment zones without requiring drilling or milling of the sleeve while allowing for full flow of fluids after treatment. A number of plugs or pistons having sequentially smaller central bores allows for balls to sequentially be inserted through the tool to selectively close off the pistons to isolate one zone from another. A release tool may inserted into the tool to engage and unthread the plugs to open up the inner diameter of the tool to allow greater production flow through the tool. The plugs may have mating tabs and holes so that as each plug is unthreaded it falls to the next plug and engages so that each plug may sequentially be unthreaded from the sleeve.

14 Claims, 2 Drawing Sheets

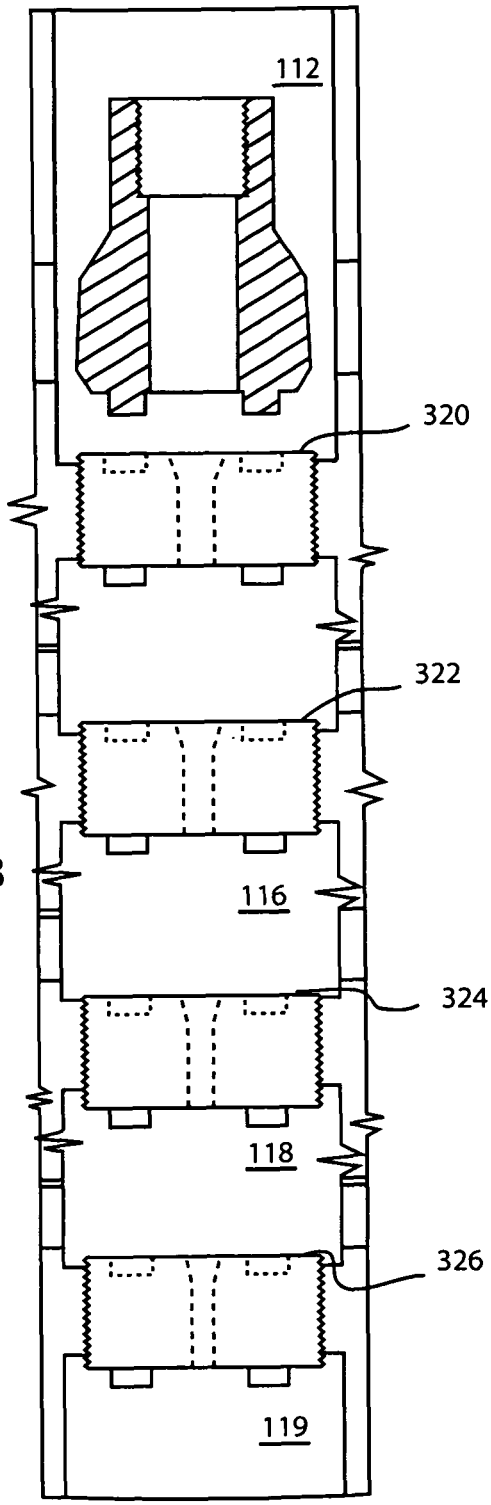
FIG. 3
FIG. 4
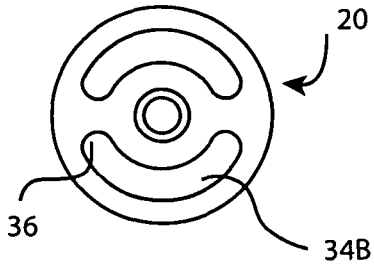
FIG. 5
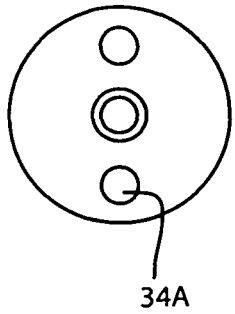

FRAC SLEEVE WITH ROTATIONAL INNER DIAMETER OPENING

CROSS REFERENCE TO RELATED APPLICATIONS

This application claims the benefit of U.S. Provisional Application 61/111,448, filed Nov. 5, 2008, entitled Frac Sleeve with Rotational Inner Diameter Opening, which is incorporated herein by reference.

BACKGROUND OF THE INVENTION

1. Field of the Invention

The present application is to a method of sequentially drilling a number of frac sleeves in a down hole well. The design enables the removal of fracture sleeve pistons from between treatment zones without requiring drilling or milling of the sleeve while allowing for full flow of fluids after treatment.

2. Description of the Prior Art

Down hole wells for natural gas and other liquids or gases are typically decided into zones for exploration, production, etc. These zones are areas of the well at different depths into the earth. Although any separation depth may be used, the zones are often around 100 feet apart. In order to work on these zones, they must be isolated from each other by packers and other devices. Many of the tools currently in use are "one time" tools, meaning that they are run in and perform their function and then are pulled out or are destroyed in situ in order that subsequent operations may be performed. This adds to the cost of production and often the amount of time and man power necessary to retrieval natural gas or other valuable commodities from the ground.

What is needed is a tool that has a way to readily address individual zones and elements of the down hole tools and that can be used more than once and does not require lengthy run ins and run outs of the tool.

None of the above inventions and patents, taken either singly or in combination, is seen to describe the instant invention as claimed.

SUMMARY OF THE INVENTION

Accordingly, it is a principal object of a preferred embodiment of the invention to provide a fracture sleeve tool that divides a well into multiple zones and can selectively separate the zones and work on any particular zone.

It is another object of the invention to provide a tool that can address a particular work zone by dropping a ball of a diameter associated with that zone to isolate lower zones from the desired zone.

It is a further object of the invention to provide isolation pistons or plugs between the zones that receive a ball in its bore to isolate one zone from another, while allowing the tool to be easily inserted or removed.

Still another object of the invention is to provide multiple isolation pistons that have cooperating tabs and detents for stacking the pistons as they are removed so that one removal tool can subsequently act on lower pistons until they are all removed to enhance flow of natural gas or other liquids or gases through the tool during production or for other reasons.

It is an object of the invention to provide improved elements and arrangements thereof in an apparatus for the purposes described which is inexpensive, dependable and fully effective in accomplishing its intended purposes.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

FIG. 3 shows a diagrammatic view of several zone isolations tools and a removal tool therefor.

FIG. 4 is a top view of a plug according to embodiments of the present disclosure.

FIG. 5 is a top view of a plug according to embodiments of the present disclosure.

Similar reference characters denote corresponding features consistently throughout the attached drawings.

DETAILED DESCRIPTION OF THE PREFERRED EMBODIMENT(S)

The present application is to a method of sequentially drilling a number of frac sleeves in a down hole well. The design enables the removal of fracture sleeve pistons from between treatment zones without requiring drilling or milling of the sleeve while allowing for full flow of fluids after treatment.

Figure 2:
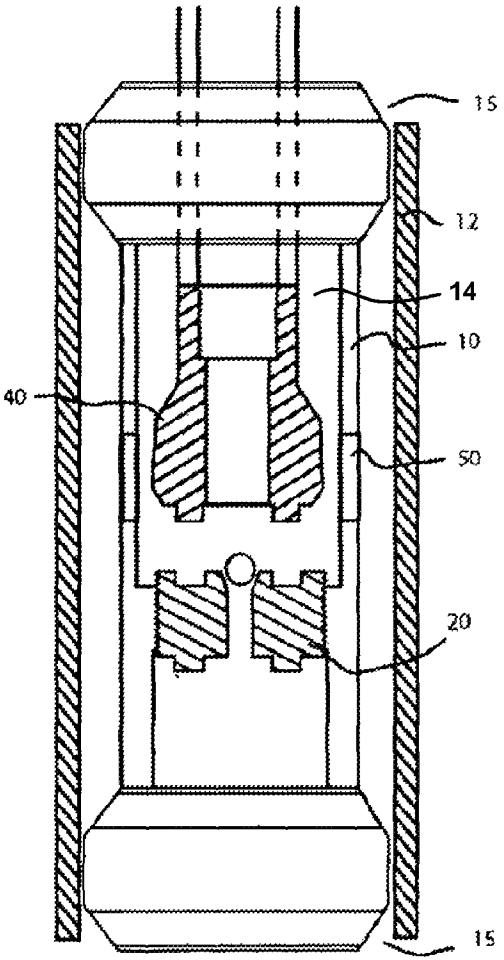
FIG. 2 is a diagrammatic view of a zone isolation tool in a well casing surrounded by a number of packers.
Figure 1:
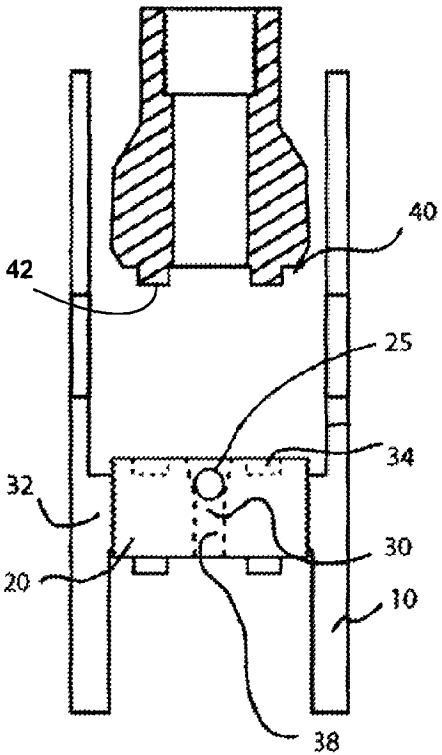
FIG. 1 is diagrammatic view of a zone isolation piston according to a preferred embodiment of the invention.

Referring to FIGS. 1-5, shows a sleeve 10 for installation into a down hole well (not shown) having a casing 12. The sleeve 10 defines an inner bore 14 therethrough. The sleeve has at least one fracture sleeve piston ("plug") 20 extending the width of the sleeve to separate the pressure zones above and below the piston 20. Seals 15 may be provided between portions of the sleeve or casing and the well to provide isolated treatment zones at various spacings. These seals may take the form of mechanical packers or other seals. These packers may be set in known manners such as pressurizing the inner diameter of the casing or sleeve.

A ball 25 may be used to selectively close a passageway 38 by seating in seat 30 provided in the passageway 38 after installation. The ball may be provided so that fluid may move upwardly through a central passageway to facilitate lowering of the sleeve into the well. By allowing fluid to pass upwardly, fluid displaced by the lowered sleeve will not hinder the downward travel of the sleeve. That is to say, the central passageway acts as a pressure relief valve to allow displaced fluids to escape making insertion of the sleeve easier. However, for the reasons provided below, the ball is preferably installed after the installation of the sleeves.

Preferably, the central passageway does not allow fluid to travel downwardly during operation. While fluid is being pumped to the surface, it is desirable to prevent the pumped fluids from traveling downward from one zone to a lower zone, since the fluids such as natural gas or oil are being pumped or otherwise brought to the surface. The check valve, ball valve or other device will remain seated when the pressure above the plug is higher than the pressure below the valve thus separating the zones. The pocket or seat 30 may be sized deep enough to prevent flow from the port 50 from unseating and flowing the ball out of the piston 20.

Once the sleeves and casing are in place in a well bore, a ball may be dropped down the casing (and any intervening drill string, etc.) to a predetermined fracture sleeve below. By providing different diameter valve seats 30 and passages 38 in the various pistons as shown in FIG. 3, the individual pistons can be independently addressed. For example if the upper piston 320 has a valve passage diameter of 2 inches and the lowermost piston has a valve seat or passage diameter of 0.75 inches, then dropping a 1 inch ball through the casing will result in the ball passing through the upper pistons (assuming they are all larger than 1 inch) until it seats in the lower most piston. Pressurizing of the lowermost isolation zone 118 could then occur.

Pressurizing the zone 118 can be achieved by using air, nitrogen or fluid to hydraulically (or pneumatically) open the pre-weakened fracture sleeves 50 in the walls to create slots communicating with the surrounding well. The well can then be treated such as by acid stimulation of any kind to promote flow or for other reasons. The devices may thus be used to channel pressure directly to the lowermost zone instead of higher areas such as hosing, tubing or the like.

Once the particular area has been treated, the well may be put in production or a ball may be placed above and/or below the zone to temporarily shut off the affected area. The next zone 116 above may be treated by inserting a ball having a diameter such as to block the next piston 324 above. The above zone 116 can be treated with the pressure of that zone acting to keep the ball between the previous zone 118 and the current zone 116 securely in place as the high pressure in the zone being treated will force the interposed ball to remain in place. This may be continued until all of the zones have been treated.

Once all of the zones have been treated and the well is put into production, it may be desirable to increase the effective diameter of the sleeve for pumping. The plugs 320-326, while useful for restricting the casing into different zones 112-119, acts as a bottleneck or restrictor during production. In the past, drilling or milling has been used to open up the passageway to allow faster production. The current invention uses selectively detachable plugs to quickly and reliably open up the effective internal diameter of the casing.

In practice, each plug 20 is threadedly attached to the sleeve by mating threads 32 on the sleeve and plug 20. Other means could also be used to selectively attach the plug to the sleeve such as shear pins, adhesive, interference fit or the like. Each of these attachments can be overcome by a twisting force applied by a rotatable retrieval tool 40.

Any pressurizing tubing can be retrieved from the hole, if necessary, and a tool attached to coil tubing or production tubing (not shown) can be run in the hole to the first piston. The tool 40 has tabs 42 which mate with respective detents 34 in plug 20 (FIG. 4). It should be noted where one tool or surface has "detents" and another has "projecting tabs," that these could easily be reversed or varied as long as respective tool or adjacent pistons have respective mating tabs and detents on the facing surface.

By applying a downward force on the tool 40 (e.g., a set down pressure of one thousand pounds) and rotating the tool slowly, the tabs and detents and fall into registration and the tab will enter the detent to lock the tab with the tool. The tool may be rotated by applying right hand rotation, for example, from the surface or by a mud motor device. A turn of 5-6 rotations may typically be necessary to completely unthread the piston from the casing.

While the tabs preferably have circular cross-sections, e.g., cylindrical, the detents may be any shape which receives a respective tab. FIG. 5 shows a cylindrical hole 34A defined in plug 20. FIG. 4 shows an alternate, arcuate configuration of the receiving hole 34B. The area receiving the plug has been substantially increased to facilitate receiving the tab 42. Once engaged with the piston at hole 34B, rotation of the tool 40 will cause the tabs 42 to abut the end of the hole 34B at which point further rotation will rotate the plug with the tool 40. The potential lost motion between the plug and the tool should not be a concern as the plug does not normally need to be rotated in the opposite direction, however an end wall 36 at the opposite end of the hole can be acted on by the tab to cause rotation in the opposite direction.

Rotation of the tool 40 against the walls of the detent 34 will apply a torque to the plug 20. When a sufficient torque is applied to the plug, the plug will rotate freeing the plug from the sleeve 10. In the preferred embodiment, this involves unthreading the plug from the sleeve, allowing the plug to free fall down the sleeve 10. In other contemplated embodiments, rotation may shear a shear pin or other frangible attachment, overcome adhesive attachment between the plug and the sleeve, or free an interference-fit plug or a combination of these elements. The plug itself may also be formed of a frangible material that destroys itself on rotational movement or causes parts of the plug to retract, expand, more or overlap such that the plug is no longer attached to the sleeve.

However, preferably each of the pistons has a set of tabs at the bottom of the piston to engage the detents in the next lower piston. In this way after the first piston has been removed by for example unthreading from the casing, the piston stacks on to the next lower piston. The tool may then lowered to rotate the piston (eg., 320), which in turn rotates the next lower piston 322, until all of the affected pistons are stacked together and engageable with each other. The outer diameter of each piston may be the same causing each piston to thread into the casing below and unthread with further rotations, or each lower piston may be larger to keep higher pistons from interfering with the threads and casing below. In other words, if the higher pistons are smaller, then will their threads will not engage the threads of the lower casing threads as the stacked pistons are unthreaded below. The pistons may be weighted or shaped to encourage or cause the piston to maintain the proper orientation as it falls to the next piston ("plug") so that the pistons will stack properly.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

I claim:

1. A method of treating a down hole well zone comprising:

providing a zone treatment tool having at least a first and second zone treatment sleeves separated by seals;

providing each of said first and second zone treatment sleeves with a threaded inner wall and a piston plug threaded to said threaded inner wall;

providing each of said first and second zone treatment sleeve piston plugs on said number of zone treatment sleeves with a plurality of detents on one of said upper and lower surfaces, and providing the respective other of said upper and lower surfaces with a plurality of projecting tabs, wherein each of said first and second piston plugs define a ball valve seat and bore therethrough, whereby said first piston pug selectively provides fluid communication between an upper zone above said first piston plug and an intermediate zone below said first piston plug and above said second piston plug, and whereby said second piston plug selectively provides fluid communication between the intermediate zone above said second piston plug and a lower zone below said second piston plug;

connecting said zone treatment tool to an amount of tubing and lowering the tool into a down hole well to an area to be treated;

dropping a ball sized to fit in at least one of the ball valve seats to seal at least one zone from another zone;

lowering a retrieval tool into the down hole well, said retrieval tool having one of a plurality of detents and a plurality of projecting tabs to mate with respective projecting tabs or detents on said first piston plug upper surface;

rotating said retrieval tool to release said piston plug from the inner wall by unthreading the tool until the piston plug is free from said first zone treatment sleeve;

dropping said first piston plug into registration with said second piston plug by mating one of said first piston plug plurality of detents and said first piston plugs with a respective mating one of said piston plug plurality of detents and said second piston plugs;

lowering said retrieval tool into registration with said first piston plug; and rotating said first piston plug to unthread said second piston plug from said second first zone treatment sleeve.

2. The method of claim 1, further comprising:

dropping a second ball sized to fit in at least one second one of the ball valve seats to seal at least one zone from another zone.

3. The method of claim 1, wherein the rotating shears at least one shear pin.

4. The method of claim 1, further comprising providing a downward force on the retrieval tool.

5. The method of claim 1, further comprising rotating the retrieval tool in an opposite direction from the rotating to release said piston plug from the inner wall.

6. The method of claim 1, further comprising treating at least one of the upper zone, the intermediate zone, and the lower zone.

7. A method of treating a down hole well zone comprising:

disposing a zone treatment tool in a wellbore, wherein the zone treatment tool comprises:

a first zone treatment sleeve, the first zone treatment sleeve threadably connected to a first piston plug, and a second zone treatment sleeve, the second zone treatment sleeve threadably connected to a second piston plug;

disposing a retrieval tool into the wellbore;

engaging the retrieval tool with the first piston plug;

disconnecting the first piston plug from the first zone treatment sleeve by rotating the engaged retrieval tool; and disconnecting the second piston plug from the second zone treatment sleeve.

8. The method of claim 7, wherein engaging the retrieval tool with the first piston plug includes mating means for engaging the retrieval tool and the first piston plug.

9. The method of claim 8, wherein the means for engaging the retrieval tool and the first piston plug comprises a plurality of tabs on the retrieval tool configured to engage a plurality of detents of the first piston plug.

10. The method of claim 7, further comprising dropping a ball from the surface of the wellbore, wherein the ball engages at least one of the first and second piston plugs.

11. The method of claim 7, wherein the disconnecting the piston plug from the first zone treatment sleeve allows the piston plug to free fall down the first zone treatment sleeve.

12. The method of claim 7, further comprising engaging the first piston plug with the second piston plug.

13. The method of claim 7, wherein disconnecting the second piston plug includes disconnecting the second piston plug while the first piston plug is mechanically engaged with the second piston plug.

14. The method of claim 7, wherein the first and second piston plugs control fluid flow in an inner bore defined by the first and second sleeves.

* * * * *